US007628456B1

(12) United States Patent
Swartz

(10) Patent No.: US 7,628,456 B1
(45) Date of Patent: Dec. 8, 2009

(54) HEAD RESTRAINT DEVICE AND METHOD THEREFOR

(76) Inventor: Gwendolyn Swartz, 16584 N. 109th Pl., Scottsdale, AZ (US) 85255

( * ) Notice: Subject to any disclaimer, the term of this patent is extended or adjusted under 35 U.S.C. 154(b) by 0 days.

(21) Appl. No.: 12/391,512

(22) Filed: Feb. 24, 2009

(51) Int. Cl.
*A62B 35/00* (2006.01)
*A47C 7/38* (2006.01)

(52) U.S. Cl. ..... 297/464; 297/393; 297/397

(58) Field of Classification Search ..... 297/393, 297/397, 464, 391; 2/209.13
See application file for complete search history.

(56) References Cited

U.S. PATENT DOCUMENTS

| | | | | |
|---|---|---|---|---|
| 270,242 | A * | 1/1883 | Mitchell | 297/393 |
| 1,491,146 | A | 4/1924 | Larson | |
| 3,667,074 | A | 4/1924 | Emery | |
| 2,765,480 | A | 10/1956 | Mueller | |
| 2,952,856 | A | 9/1960 | Ruff | |
| 4,031,578 | A | 6/1977 | Sweeney et al. | |
| 4,097,086 | A | 6/1978 | Hudson | |
| 4,182,322 | A * | 1/1980 | Miller | 5/637 |
| 5,168,590 | A | 12/1992 | O'Sullivan | |
| D338,587 | S | 8/1993 | Harnish | |
| 5,265,625 | A | 11/1993 | Bodman | |
| 5,306,232 | A | 4/1994 | Whitmyer | |
| 5,503,456 | A | 4/1996 | Rossini | |
| D382,164 | S | 8/1997 | Hays | |
| D445,506 | S | 7/2001 | Vinson et al. | |
| 6,289,538 | B1 | 9/2001 | Fidge | |
| 6,347,421 | B1 | 2/2002 | D'Emilio | |
| 6,386,639 | B1 * | 5/2002 | McMichael | 297/464 |
| 6,484,335 | B2 | 11/2002 | Gilbert | |
| 6,607,245 | B1 * | 8/2003 | Scher | 297/393 |
| 6,748,615 | B1 * | 6/2004 | Tiedemann | 5/640 |
| 6,799,802 | B1 * | 10/2004 | Moran | 297/393 |
| 7,530,634 | B1 * | 5/2009 | Mortazavi et al. | 297/219.12 |
| 2005/0268377 | A1 * | 12/2005 | Massey | 2/209.13 |

* cited by examiner

*Primary Examiner*—Milton Nelson, Jr.
(74) *Attorney, Agent, or Firm*—Jeffrey D. Moy; Craig Weiss; Weiss & Moy, P.C.

(57) ABSTRACT

A head restraint device and method therefor capable of being coupled to an article of furniture and capable of comfortably securing the head of a user to an article of furniture so that the user may rest in the article of furniture with his or her head secured in a substantially upright position.

7 Claims, 2 Drawing Sheets

Fig. 2A
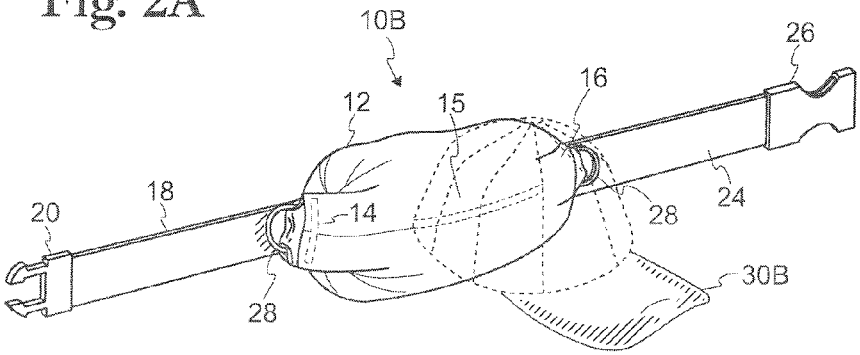
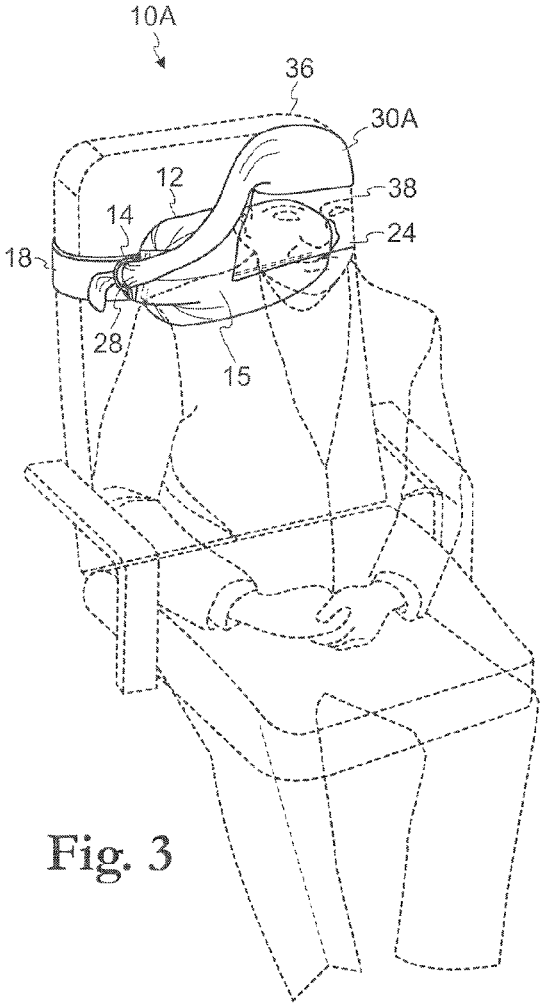
Fig. 3
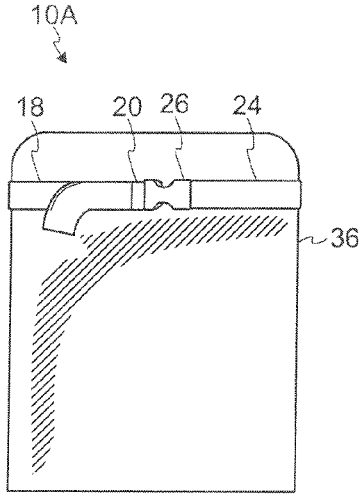
Fig. 4

HEAD RESTRAINT DEVICE AND METHOD THEREFOR

FIELD OF THE INVENTION

This invention relates generally to head and neck support systems and, more specifically, to a head restraint device and method therefor capable of being attached to an article of furniture to allow the user secure his or her head with the head restraint device while resting in the article of furniture.

BACKGROUND OF THE INVENTION

Many people have experienced illnesses or injuries which prevent them from having complete muscle control in their neck. Accordingly, the use of typical furniture by these people may prove to be cumbersome in that the article of furniture must be reclined or otherwise altered from its typical form in order for the user's head to remain upright. Unfortunately, this may sometimes provide an unsatisfactory or awkward solution to the problem.

This invention addresses this problem by providing a head restraint device capable of being attached to an article of furniture while at the same time able to secure the head of a user to the head restraint device. This enables a user to use the article of furniture with their head comfortably restrained and resting in an upright position without relying on significant use of their neck muscles.

SUMMARY OF THE INVENTION

An object of the present invention is to provide a head restraint device having the ability to be attached to an article of furniture and having the ability to secure the head of a person using the article of furniture to the head restraint device without substantial aid of the user's own strength.

It is a further object of the present invention to provide a comfortable way for keeping the head of a user relatively upright when resting on an article of furniture without the need for substantial modification to the article of furniture.

BRIEF DESCRIPTION OF THE PREFERRED EMBODIMENTS

In accordance with one embodiment of the present invention, a head restraint device is disclosed, comprising, in combination, a cushion, an attachment device coupled to the cushion, the attachment device dimensioned to attach the cushion to an article of furniture, and a restraining device coupled to the cushion, the restraining device dimensioned to couple at least a portion of a head of a user to the cushion.

In accordance with another embodiment of the present invention, a method for restraining a head of a user is disclosed, comprising, in combination, the steps of providing an article of furniture, providing a cushion having an attachment device coupled to the cushion and a restraining device coupled to the cushion, attaching the attachment device to the article of furniture, positioning a user on the article of furniture with a back of the neck of the user proximate the cushion, adjusting the restraining device to couple at least a portion of a head of the user to the cushion.

In accordance with another embodiment of the present invention, a head restraint device is disclosed, comprising, in combination, a cushion having a first portion and a second portion, a first strap having a first end and a second end, the first end coupled to the first portion of the cushion, a male coupling member coupled proximate the second end of the first strap, a second strap having a first end and a second end, the first end of the second strap coupled to the second portion of the cushion, a female coupling member coupled proximate the second end of the second strap, the female coupling member dimensioned to mate with the male coupling member, the second end of the first strap and the second end of the second strap dimensioned to wrap around an article of furniture and be coupled with the male coupling member and the female coupling member, a sheet of material having a first end coupled to the cushion and a second end having a first corner and a second corner and a center portion therebetween, the center portion dimensioned to cover at least a portion of a head of a user, the first corner of the sheet of material dimensioned to be coupled to a first portion of the cushion and the second corner of the sheet of material dimensioned to be coupled to a second portion of the cushion in order to secure a head of a user to the cushion in order to secure a head of a user to the cushion in a substantially upright position, and at least one pair of one of D-rings and O-rings coupled to the first portion of the cushion and the second portion of the cushion for securing the sheet of material coupled to the cushion for restraining a head of a user.

The foregoing and other objects, features, and advantages of the invention will be apparent from the following, more particular description of the preferred embodiments of the invention, as illustrated in the accompanying drawings.

BRIEF DESCRIPTION OF THE DRAWINGS

FIG. 2A is an elevated perspective view of the head restraint device shown in FIG. 2 with the baseball cap-like fixture shown in phantom;

FIG. 3 is an elevated perspective view of the head restraint device of FIG. 1 attached to an article of furniture and restraining the head of a user shown in phantom; and FIG. 4 is a rear view of the head restraint device of FIG. 3, showing the first strap coupled to the second strap around the back of an article of furniture.

Common reference numerals are used throughout the drawings and detailed descriptions to indicate like elements.

DETAILED DESCRIPTION OF THE PREFERRED EMBODIMENTS

Figure 1:
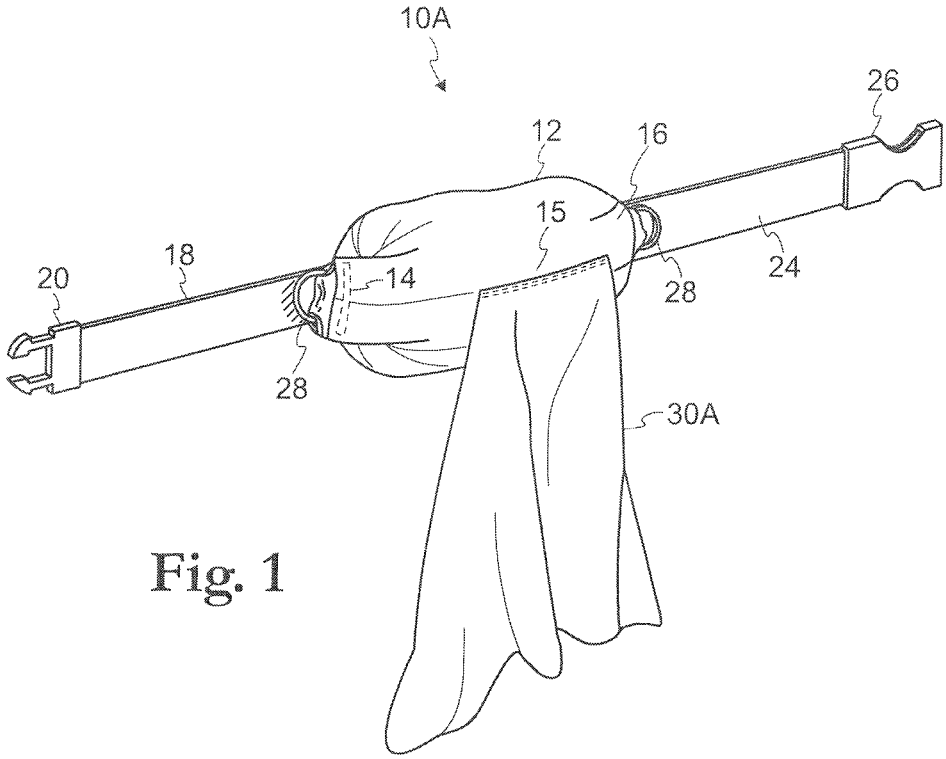
FIG. 1 is an elevated perspective view of one embodiment of the head restraint device of the present invention wherein the restraining device is a bandana-like sheet of material fixably coupled to the cushion portion of the head restraint device and capable of being secured by a pair of D-rings.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

Referring to FIGS. 1-4, various embodiments of a head restraint device, referred to generically as a head restraint device 10, are disclosed. The head restraint device 10 comprises a cushion 12 (shown in FIGS. 1-3) having a first portion 14 (shown in FIGS. 1-3), a center portion 15 (shown in FIGS. 1-3), and a second portion 16 (shown in FIGS. 1-3). The head restraint device 10 further comprises an attachment device 27

(shown in FIGS. 1, 2, 2A and 4) coupled to the cushion 12. The attachment device 27 is dimensioned to attach the cushion 12 to an article of furniture 36 (shown in FIGS. 3-4). In the preferred embodiment, the attachment device 27 comprises a first strap 18 having a first end 17 (shown in FIGS. 1-3) and a second end 19 (shown in FIGS. 1, 2, 2A and 4) and a second strap 24 having a first end 23 (shown in FIGS. 1, 2A and 3) and a second end 25 (shown in FIGS. 1, 2, 2A and 4). Preferably, the first end 17 of the first strap 18 is coupled to the first portion 14 of the cushion 12 and the first end 23 of the second strap 24 is coupled to the second portion 16 of the cushion 12. The second end 19 of the first strap 18 and the second end 25 of the second strap 24 are preferably dimensioned to wrap around an article of furniture 36 and be coupled to one another. In the preferred embodiment, the second end 19 of the first strap 18 comprises a male coupling member 20 (shown in FIGS. 1, 2, 2A and 4) and the second end 25 of the second strap 24 comprises a female coupling member 26 (shown in FIGS. 1, 2, 2A and 4) dimensioned to be coupled to the male coupling member 20 to secure the cushion 12 to an article of furniture 36. However, it should be clearly understood that substantial benefit could be derived from an alternative embodiment of the present invention in which a mechanism other than the male coupling member 20 and female coupling member 26 is used for connecting the first strap 18 and second strap 24 (such as a hook and loop fastener, buttons, hooks, snaps, etc.) or in which a mechanism other than straps 18 and 24 are used to attach the cushion 12 to an article of furniture 36, such as a drawstring or an elastic band.

Figure 2:
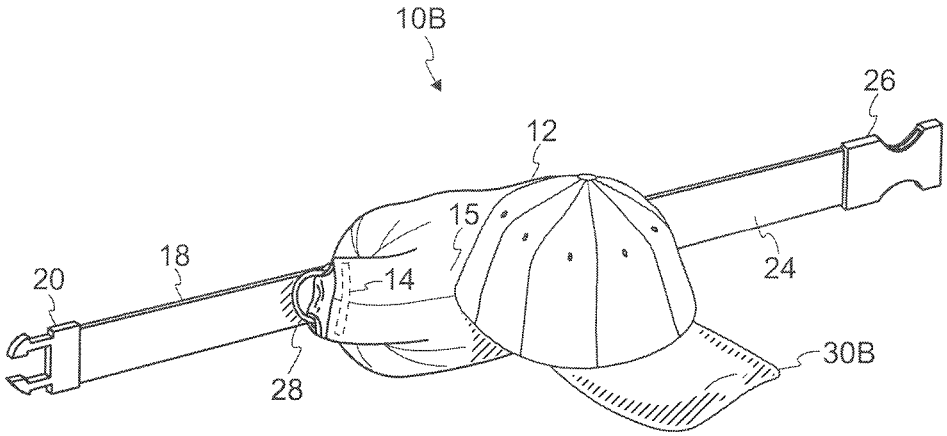
FIG. 2 is an elevated perspective view of one embodiment of the head restraint device of the present invention wherein the restraining device is a baseball cap-like fixture fixably coupled to the cushion portion of the head restraint device and capable of being placed about the head of a user.

Referring now to FIGS. 1-3, the head restraint device 10 further comprises a restraining device 30*a* or 30*b* coupled to the cushion 12. The restraining device 30*a* or 30*b* is dimensioned to couple at least a portion of a head 38 of a user to the cushion 12. In the preferred embodiment, the restraining device 30*a* or 30*b* is coupled to a center portion 15 of the cushion 12, though it should be clearly understood that substantial benefit could be derived from an alternative embodiment of the present invention in which the restraining device 30*a* or 30*b* is coupled to another area of the cushion 12 so long as the restraining device 30*a* or 30*b* is securely coupled to the cushion 12.

Referring now to FIGS. 1 and 3, a first embodiment of the head restraint device 10 hereinafter referred to as head restraint device 10*a*, is shown. In the preferred version of the head restraint device 10*a*, the restraining device 30*a* or 30*b* is a sheet of material 30*a* (preferably a bandana-like sheet of material, though any material capable of securing the head 38 of a user is within the spirit and scope of this invention). The sheet of material 30*a* has a first end 31 (shown in FIG. 1) preferably coupled to the center portion 15 of the cushion 12, though it should be clearly understood that substantial benefit could be derived from an alternative embodiment of the head restraint device 10*a* in which the sheet of material 30*a* is coupled to some other area of the cushion 12 so long as sheet of material 30*a* is securely coupled to the cushion 12. The sheet of material 30*a* has a second end 40 (shown in FIG. 1) having a first corner 33 (shown in FIGS. 1 and 3), a second corner 35 (shown in FIG. 1) and a center portion 37 (shown in FIGS. 1 and 3) therebetween. As shown in FIG. 3, the center portion 37 is dimensioned to cover at least a portion of a head 38 of a user and secure the head 38 in a substantially upright position while the first corner 33 of the sheet of material 30*a* is coupled to the first portion 14 of the cushion 12 and the second corner 35 is coupled to the second portion 16 of the cushion 12.

Still referring to FIGS. 1 and 3, the head restraint device 10*a* preferably comprises a first securing device 28 coupled to the first portion 14 of the cushion 12 and a second securing device 29 coupled to the second portion 16 of the cushion 12. The first securing device 28 is dimensioned to receive and secure the first corner 33 of the sheet of material 30*a* to the cushion 12. The second securing device 29 is dimensioned to receive and secure the second corner 35 of the sheet of material 30*a* to the cushion 12. Preferably, the first securing device 28 and the second securing device 29 are D-rings or O-rings, however, it should be clearly understood that substantial benefit could be derived from an alternative embodiment of the present invention which uses a mechanism other than D-rings or O-rings to couple the sheet of material 30*a* to the first portion 14 and second portion 16 of the cushion 12, such as hook and loop fasteners or even an aperture defined by the first portion 14 and the second portion 16 to receive, respectively, the first corner 33 and the second corner 35.

Referring now to FIGS. 2 and 2A, a second embodiment of the head restraint device 10, hereinafter referred to as head restraint device lob, is shown. The head restraint device 10*b* is essentially the same as the head restraint device 10*a* except that the restraining device 30*a* or 30*b* is a cap/hat 30*b* instead of a sheet of material 30*a*. In the preferred version of this embodiment, the restraining device 30*a* or 30*b* is a cap-like piece of material 30*b* coupled to the center portion 15 of the cushion 12. However, it should be clearly understood that substantial benefit could be derived from an alternative embodiment of the present invention which uses a restraining device 30*a* or 30*b* other than a cap-like piece of material 30*b*, such as a differently shaped hat, so long as the head covering is capable of securing at least a portion of a head 38 of a user to the cushion 12.

STATEMENT OF OPERATION

In accordance with one embodiment of the head restraint device 10, a cushion 12 is secured to an article of furniture 36. A user is then preferably positioned with the back of the neck of the user proximate the cushion 12 with at least a portion of the user's head 38 above the cushion 12. The restraining device 30*a* or 30*b* is then adjusted to couple at least a portion of a head 38 of a user to the cushion 12. The restraining device 30*a* or 30*b* could be a hat 30*b*, as shown in FIGS. 2 and 2A, in which case it may be sufficient to securely place the hat 30*b* on the user's head 38. Alternatively, the restraining device 30*a* or 30*b* could be a sheet of material 30*a*, as shown in FIGS. 1 and 3, that is placed over at least a portion of the user's head 38. Once over at least a portion of the head 38 (and preferably the forehead) of a user, the first corner 33 of the sheet of material 30*a* is then secured to the first portion 14 of the cushion 12 and the second corner 35 is secured to the second portion 16 of the cushion 12. In the head restraint device 10*a*, the first corner 33 is preferably secured to the first portion 14 of the cushion 12 through the use of a first securing device 28 and the second corner 35 is preferably secured to the second portion 16 of the cushion 12 through the use of a second securing device 29. Preferably, the first securing device 28 and the second securing device 29 are either D-rings or O-rings that a corner of material can be passed through and secured so that the corners 33 and 35 cannot be removed by pulling alone (such as the pulling of a head that is pitching forward). Another securing mechanism other than the first securing device 28 and the second securing device 29 could be used so long as the sheet of material 30*a* can be secured to the cushion 12 so that the user's head 38 can be maintained in a substantially upright position without the sheet of material 30*a* accidentally coming loose.

While the invention has been particularly shown and described with reference to preferred embodiments thereof, it will be understood by those skilled in the art that the foregoing and other changes in form and details may be made therein without departing from the spirit and scope of the invention.

I claim:

1. A head restraint device comprising:

a cushion;

an attachment device coupled to said cushion, said attachment device dimensioned to attach said cushion to an article of furniture; and a restraining device coupled to said cushion, said restraining device dimensioned to couple at least a portion of a head of a user to said cushion, said restraining device comprising a sheet of material having a first end coupled to a center portion of said cushion and a second end having a first corner and a second corner and a center portion therebetween, said center portion dimensioned to cover at least a portion of a head of a user, said first corner of said sheet of material dimensioned to be coupled to a first portion of said cushion and said second corner of said sheet of material dimensioned to be coupled to a second portion of said cushion in order to secure a head of a user to said cushion in a substantially upright position.

2. The head restraint device of claim 1 wherein said restraining device being a bandana sheet of material.

3. The head restraint device of claim 1 wherein said attachment device comprising:

a first strap having a first end and a second end, said first end of said first strap coupled to a first portion of said cushion and said second end of said first strap dimensioned to wrap around at least a portion of an article of furniture; and a second strap having a first end and a second end, said first end of said second strap coupled to a second portion of said cushion, said second end of said second strap coupled to said second end of said first strap in order to secure said cushion to an article of furniture.

4. The head restraint device of claim 3 wherein said second end of said first strap comprises a male coupling member and said second end of said second strap comprises a female coupling member, said male coupling member dimensioned to mate with said female coupling member to secure said cushion to an article of furniture.

5. The head restraint device of claim 1 further comprising:

a first securing device coupled to said first portion of said cushion and dimensioned to secure said first corner of said sheet of material to said cushion; and a second securing device coupled to said second portion of said cushion and dimensioned to secure said second corner of said sheet of material to said cushion.

6. The head restraint device of claim 5 wherein said first securing device comprising a first pair of one of D-rings and O-rings and wherein said second securing device comprising a second pair of one of D-rings and O-rings.

7. A head restraint device comprising:

a cushion having a first portion and a second portion;

a first strap having a first end and a second end, said first end coupled to said first portion of said cushion;

a male coupling member coupled proximate said second end of said first strap;

a second strap having a first end and a second end, said first end of said second strap coupled to said second portion of said cushion;

a female coupling member coupled proximate said second end of said second strap, said female coupling member dimensioned to mate with said male coupling member, said second end of said first strap and said second end of said second strap dimensioned to wrap around an article of furniture and be coupled with said male coupling member and said female coupling member;

a sheet of material having a first end coupled to said cushion and a second end having a first corner and a second corner and a center portion therebetween, said center portion dimensioned to cover at least a portion of a head of a user, said first corner of said sheet of material dimensioned to be coupled to a first portion of said cushion and said second corner of said sheet of material dimensioned to be coupled to a second portion of said cushion in order to secure a head of a user to said cushion in a substantially upright position; and at least one pair of one of D-rings and O-rings coupled to said first portion of said cushion and said second portion of said cushion for securing said first corner and said second corner of said sheet of material to said cushion for restraining at least a portion of a head of a user.

* * * * *